US007102088B2

(12) United States Patent
Tan et al.

(10) Patent No.: US 7,102,088 B2
(45) Date of Patent: Sep. 5, 2006

(54) MULTI-DIRECTION SWITCH

(75) Inventors: Shijie Tan, Shenzhen (CN); Yusho Nakase, Fu Jin Jun (JP)

(73) Assignee: Hon Hai Precision Ind. Co., LTD, Taipei Hsien (TW)

( * ) Notice: Subject to any disclaimer, the term of this patent is extended or adjusted under 35 U.S.C. 154(b) by 0 days.

(21) Appl. No.: 11/115,608

(22) Filed: Apr. 26, 2005

(65) Prior Publication Data

US 2006/0016673 A1 Jan. 26, 2006

(30) Foreign Application Priority Data

Jul. 23, 2004 (TW) ..... 93211671 U

(51) Int. Cl.
*H01H 19/00* (2006.01)

(52) U.S. Cl. ..... 200/6 A; 200/5 A

(58) Field of Classification Search ..... 200/5 A, 200/6 A, 5 R, 6 R, 17 R, 4, 18, 329, 339, 200/512–520, 341
See application file for complete search history.

(56) References Cited

U.S. PATENT DOCUMENTS 6,794,589 B1 * 9/2004 Kubat et al. ..... 200/6 A
6,852,938 B1 * 2/2005 Nakade ..... 200/200
6,974,920 B1 * 12/2005 Yu ..... 200/6 A
6,979,785 B1 * 12/2005 Yamasaki ..... 200/6 A

FOREIGN PATENT DOCUMENTS

JP 2002-343195 A 11/2002

* cited by examiner

*Primary Examiner*—Michael Friedhofer
*Assistant Examiner*—Lisa Klaus
(74) *Attorney, Agent, or Firm*—Wei Te Chung

(57) ABSTRACT

A multi-direction switch (10) includes a housing (1), first fixed contacts (23, 24, 25, 26), common fixed contacts (22), a second fixed contact (21), a first movable contact (5), a driving device (6) and a second movable contact (3). The first movable contact includes constant contact portions (51) and movable contact portions (52). The constant contact portions touch the common fixed contacts. The second movable contact lays over the second fixed contact. The driving device is disposed on the second movable contact and includes first depressing portions (63) and a second depressing portion (65). The first depressing portions depress the movable contact portions and the second depressing portion depresses a central portion (31) of the second movable contact. The housing includes anchor grooves. The driving device includes anchor arms (64) received in the anchor grooves (14).

20 Claims, 7 Drawing Sheets

MULTI-DIRECTION SWITCH

BACKGROUND OF THE INVENTION

1. Field of the Invention

The present invention relates to a switch, and in particular to a multi-direction switch employed in portable electronic devices.

2. Description of the Prior Art

One such multi-direction input apparatus is disclosed in Japanese Publication for Laid-Open Patent Application No. 2002-343195 including a casing, which has a bottom wall disposed with a common contact; a first fixed contact, which is held by the casing; a first movable contact, which can be brought into or out of contact with the first fixed contact; a handle, which can be tilted in different directions to generate different electric signals; and a second movable contact, which touches the common contact. The first movable contact has a contact portion that touches the second movable contact. When the handle is tilted, the first fixed contact touches the first movable contact such that the conduction between the first fixed contact and the common contact is established through the first movable contact, the contact portion and the second movable contact, and a first electric signal is output.

The handle is actuated by outside force, the second movable contact and a cover of the multi-direction input apparatus. However, the handle is not supported by the casing. When the handle is titled, lack of balance often occurs in the multi-direction input apparatus. The first movable contact is combined with the handle by insert molding, thus the procedure of manufacture such multi-direction input apparatus is complex and the cost of manufacture is high.

Hence, an improved multi-direction switch is desired to overcome the above-mentioned shortcomings of the existing multi-direction input apparatus.

BRIEF SUMMARY OF THE INVENTION

It is therefore an object of the present invention to provide a multi-direction switch which has high stability.

In order to achieve the above object, an aspect of the present invention is a multi-direction switch including a housing, first fixed contacts, common fixed contacts, a second fixed contact, a first movable contact, a driving device and a second movable contact. The first fixed contacts, the common fixed contacts and the second fixed contact are positioned on the bottom of the housing. The first movable contact is disposed under the driving device and actuated by the driving device. The first movable contact includes constant contact portions and movable contact portions. The constant contact portions touch the common fixed contacts. The second movable contact lays over the second fixed contact. A peripheral portion of the second movable contact touches the common fixed contacts. The driving device is disposed on the second movable contact and includes first depressing portions and a second depressing portion. One of first depressing portions depresses one of the movable contact portions to make one of the movable contact portions touch one of the first fixed contacts. The second depressing portion depresses a central portion of the second movable contact to make the central portion touch the second fixed contact. The housing includes anchor grooves. The driving device includes anchor arms received in the anchor grooves.

Other objects, advantages and novel features of the invention will become more apparent from the following detailed description of preferred embodiments when taken in conjunction with the accompanying drawings.

DETAILED DESCRIPTION OF THE INVENTION

Figure 1:
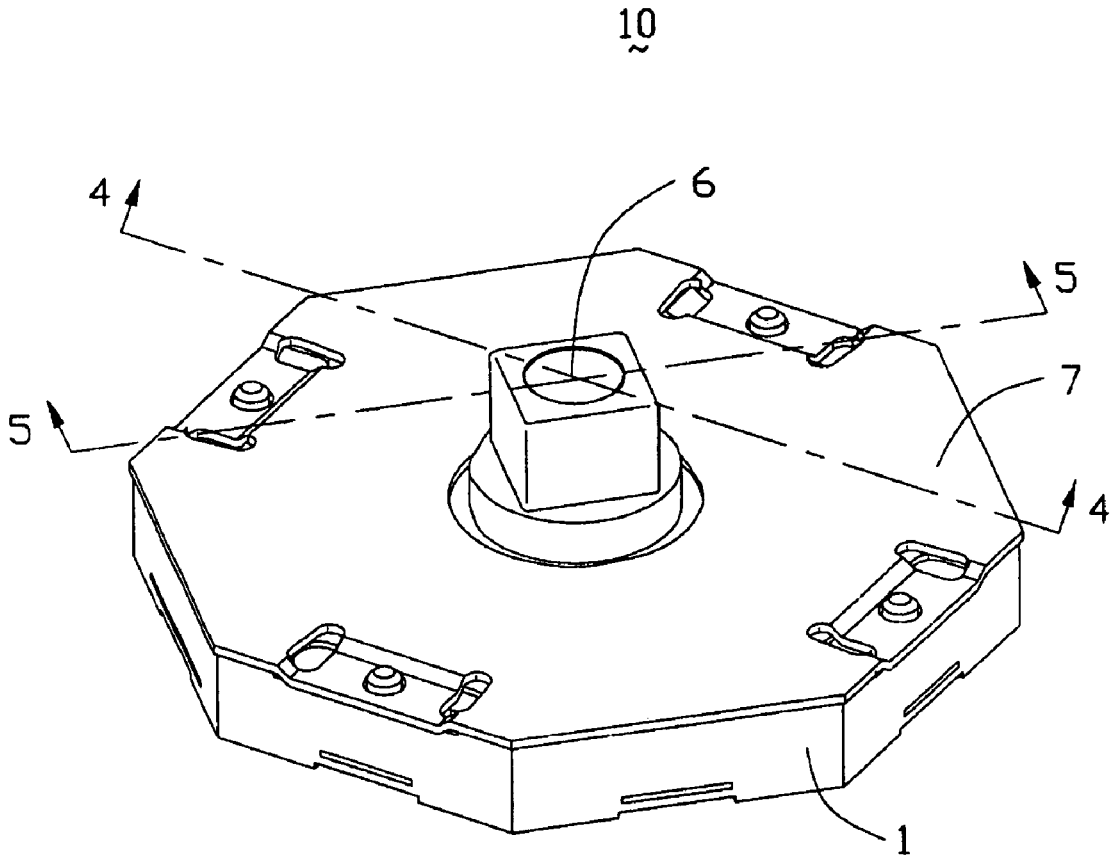
FIG. 1 is a perspective view of a multi-direction switch according to a first embodiment of the present invention.
Figure 2:
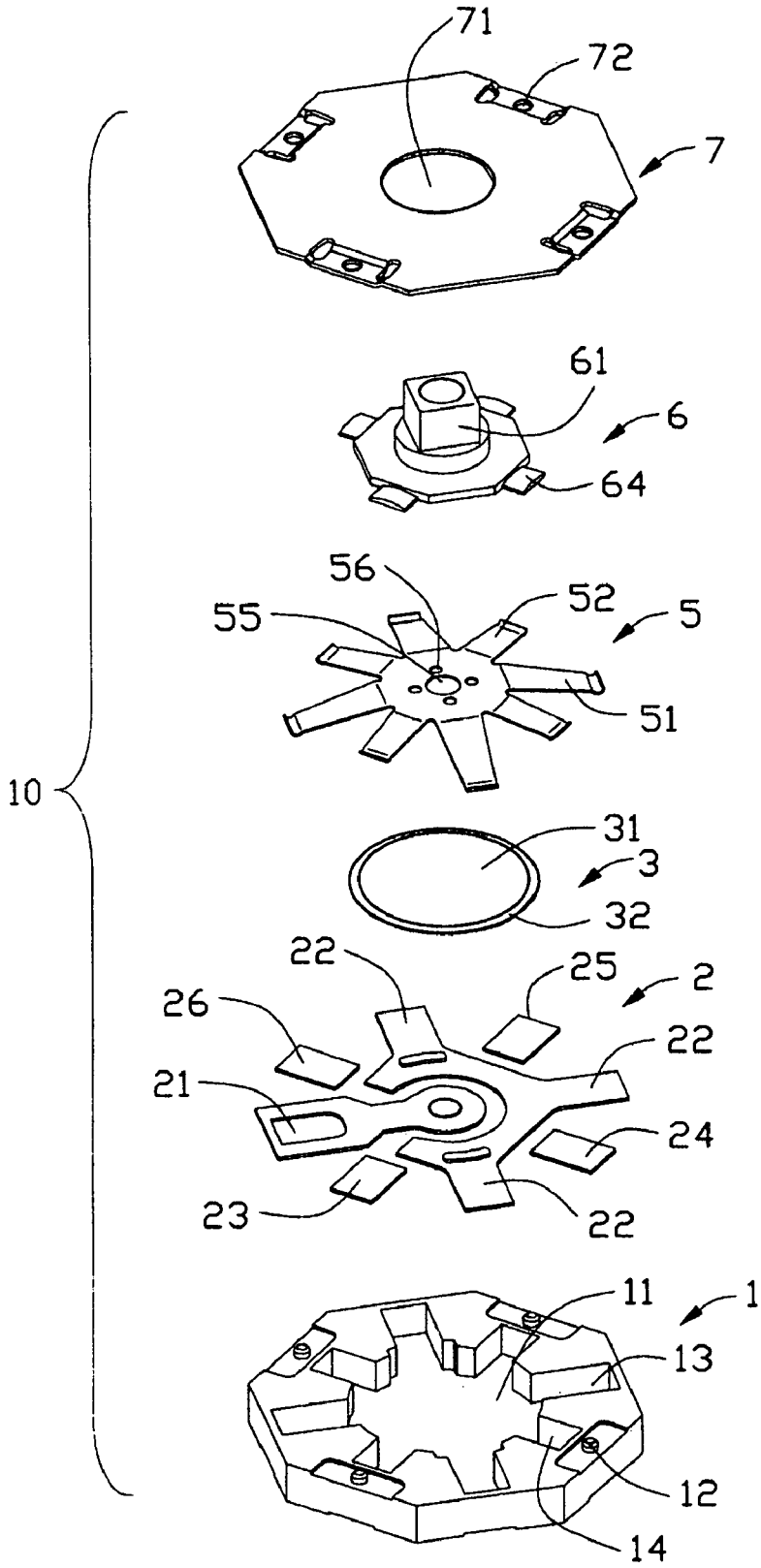
FIG. 2 is an exploded view of the multi-direction switch.
Figure 3:
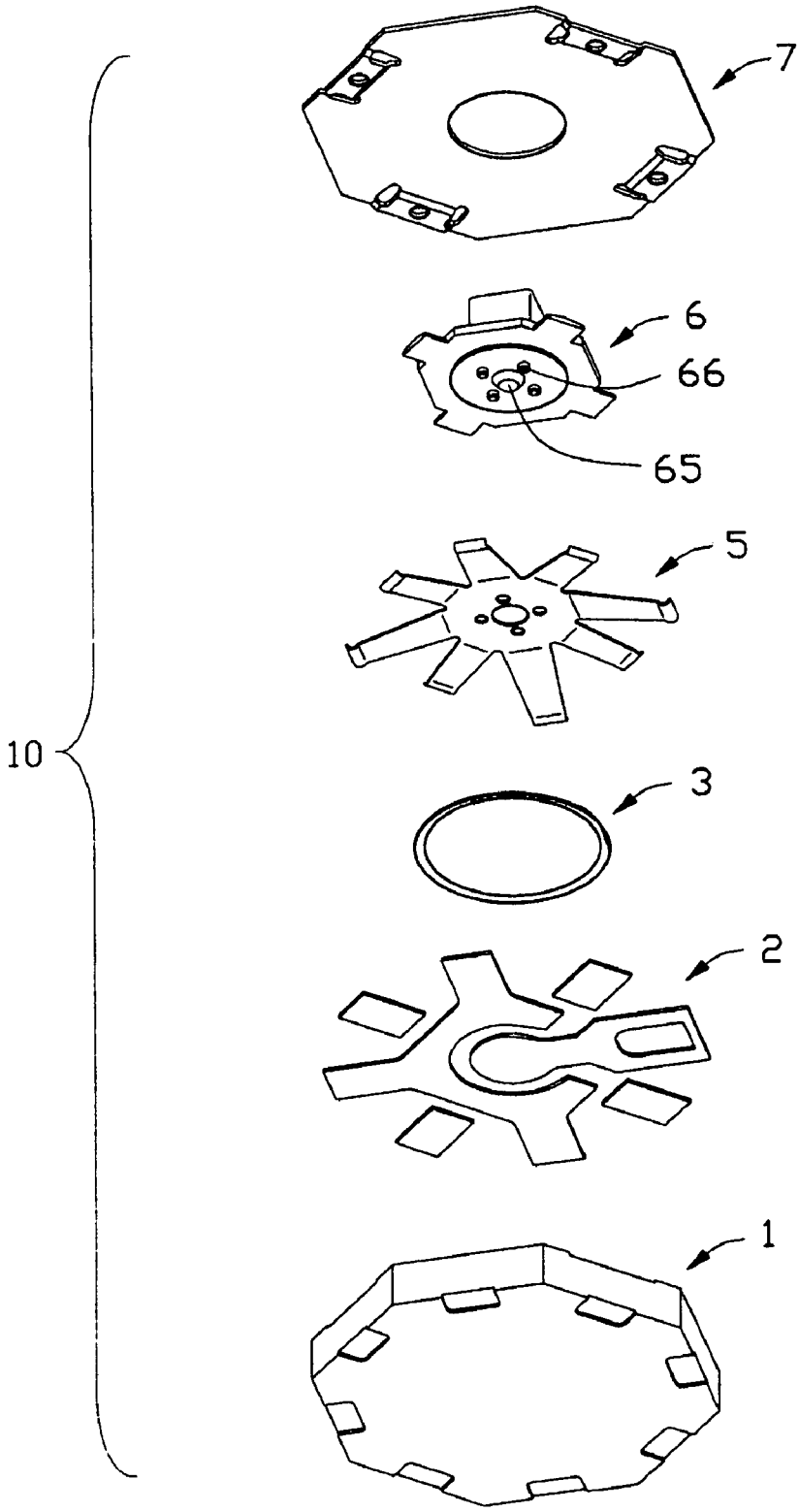
FIG. 3 is another exploded view of the multi-direction switch.

Referring to FIGS. 1, 2 and 3, a multi-direction switch 10 according to a first embodiment of the present invention includes a housing 1, fixed contacts 2, a first movable contact 5, a second movable contact 3, a driving device 6 and a cover 7.

The housing 1 includes a bottom 11, a peripheral wall upwardly surrounding the bottom 11, mounting posts 12, activity grooves 13 and anchor grooves 14 alternately defined in the peripheral wall. The housing 1 is polygonal, for example octagonal. The activity grooves 13 are longer than the anchor grooves 14 and extend in radial directions. The mounting posts 12 are disposed around the peripheral portion of the housing 1. The mounting posts 12 upwardly project towards the cover 7.

The fixed contacts 2 includes first fixed contacts 23, 24, 25, 26, a second fixed contact 21 and common fixed contacts 22. The second fixed contact 21, the common fixed contacts 22 and the first fixed contacts 23, 24, 25, 26 are separated from each other by air. The second fixed contact 21 is disposed in the bottom 11 corresponding to one of the activity grooves 13 with insert molding. The common fixed contacts 22 are disposed in the bottom 11 corresponding to the other three of the activity grooves 13 with insert molding. The first fixed contacts 23, 24, 25, 26 are disposed in the bottom 11 corresponding to the anchor grooves 14 with insert molding.

The first movable contact 5 includes alternately formed constant contact portions 51 and movable contact portions 52. The first movable contact 5 includes peripheral through holes 56 and a central through hole 55. The movable contact portions 52 are shorter than the constant contact portions 51. The peripheral through holes 56 are disposed round the central through hole 55. The constant contact portions 51 are received in the corresponding activity grooves 13. The movable contact portions 52 are received in the corresponding anchor grooves 14.

The second movable contact 3 includes a central portion 31 and a peripheral portion 32.

Figure 4:
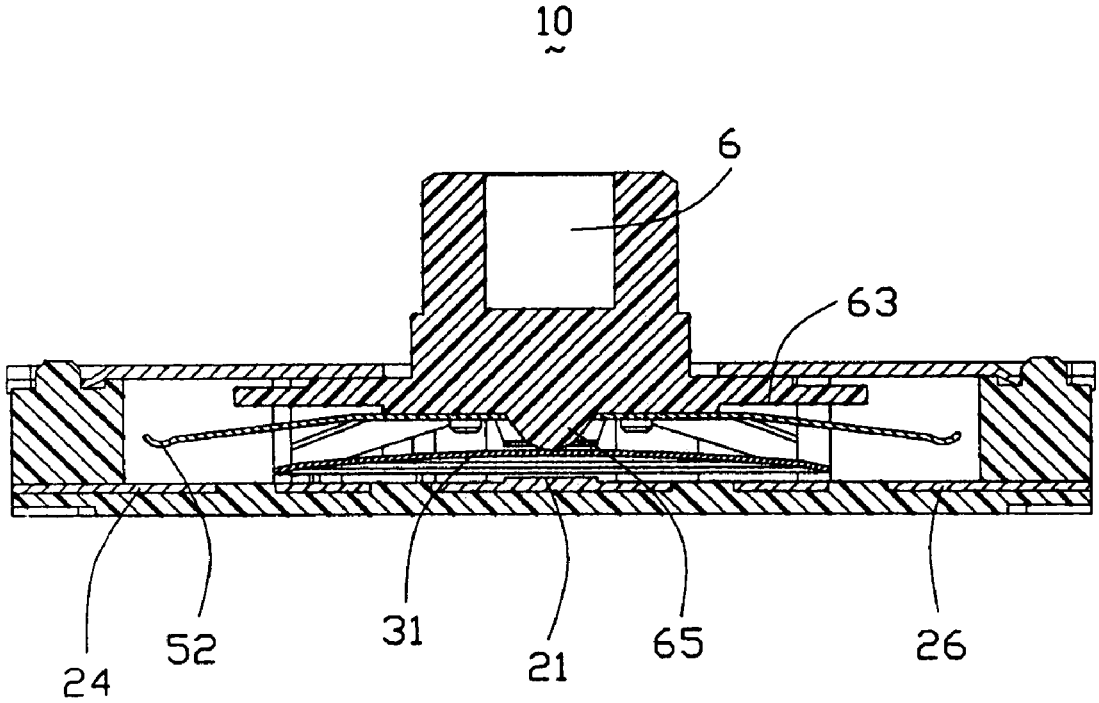
FIG. 4 is a cross-sectional view taken along the line 4—4 in FIG. 1.
Figure 5:
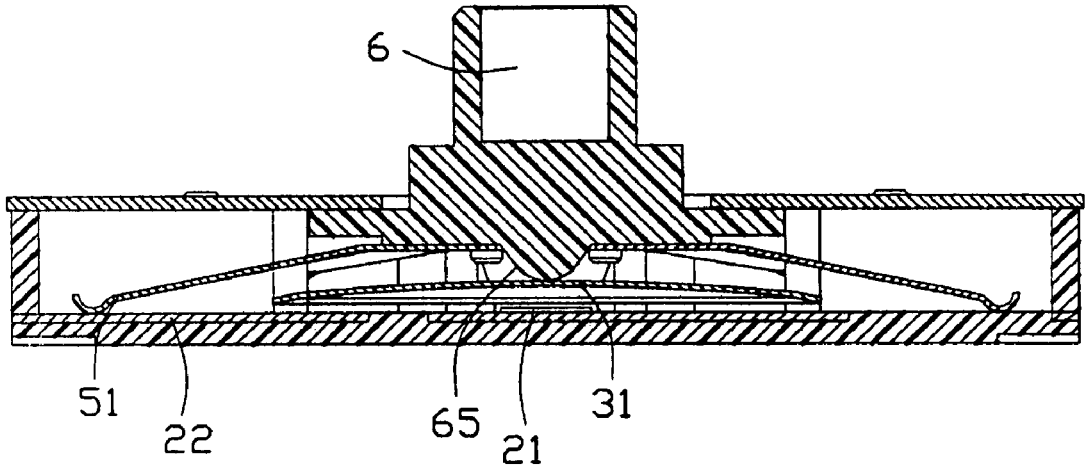
FIG. 5 is a cross-sectional view taken along the line 5—5 in FIG. 1.

The driving device 6 includes an actuating portion 61, first depressing portions 63 (FIG. 4), anchor arms 64, a second depressing portion 65 and holding posts 66. The second depressing portions 65 extends from the first depressing portions 63. The anchor aims 64 outwardly project from an edge of the driving device 6. The anchor arms 64 are thinner than the edge of the driving device 6. The holding posts 66 are disposed round the second depressing portion 65. Outer profiles of the holding posts 66 are configured to profiles of the peripheral though holes 56. An outer profile of the second depressing portion 65 is configured to a profile of the central through hole 55.

The cover 7 defines a perforative hole 71 and a plurality of mounting holes 72. The perforative hole 71 is disposed in a center of the cover 7. An inner profile of the perforative hole 71 is larger than an outer profile of the actuating portion 61. Inner profiles of the mounting holes 72 are configured corresponding to outer profiles of the mounting posts 12 for holding the mounting posts 12.

Referring to FIGS. 2, 3, 4 and 5, in assembly, the fixed contacts 2 are disposed on the bottom 11 of the housing 1. The second movable contact 3 is disposed upon the fixed contacts 2. The peripheral portion 32 contacts the common fixed contacts 22. The central portion 31 is above the second fixed contact 21. The first movable contact 5 is mounted under the driving device 6. The second depressing portion 65 is received in the central hole 55. The holding posts 66 are held in the peripheral through holes 56. The second depressing portion 65 lays against the central portion 31 of the second movable contact 3. The constant contact portions 51 touch the common fixed contacts 22. The movable contact portions 52 are separated form corresponding first fixed contacts 23, 24, 25, 26 in a normal position. The movable contact portions 52 touch corresponding first fixed contacts 23, 24, 25, 26 when the driving device 6 is titled. The cover 7 is mounted on the housing 1. The actuating portion 61 penetrates through the cover 7. The mounting holes 72 receive the mounting posts 12.

In the normal position, the central portion 31 is separated from the second fixed contact 21 and the movable contact portions 52 are separated from the first fixed contacts 23, 24, 25, 26. The constant contact portion 51 and the peripheral portion 32 contact with the common fixed contacts 22.

When the driving device 6 is depressed down, the second depressing portion 65 deforms the second movable contact 3 and the central portion 31 touches the second fixed contact 21, While the movable contact portions 52 are retained separating from the first fixed contacts 23, 24, 25, 26. The circuit between the second fixed contact 21 and the common fixed contacts 22 is closed. Thus, a first electric signal is output.

When the driving device 6 is titled towards one of the first fixed contacts 23, 24, 25, 26, one of the first depressing portions 63 depresses one of the movable contact portions 52 to touch a corresponding first fixed contact 23, 24, 25, 26. Thus, an electrical connection between the common fixed contacts 22 and the corresponding first fixed contact 23, 24, 25, 26 is established via the first movable contact 5. Secondly, the second depressing portion 65 depresses the second movable contact 3. The central portion 31 touches the second fixed contact 21. Thus, an electrical connection between the second fixed contact 21 and the common fixed contacts 22 is established via the second movable contact 3. The circuit between the second fixed contact 21, the common fixed contacts 22 and one of the first fixed contacts 23, 24, 25, 26 is closed. Thus, a second electric signal is outputted.

The anchor arms 64 are received in the anchor grooves 14 and abutting against the anchor grooves 14, thereby ensuring stable and reliable operation of the driving device 6.

Figure 6:
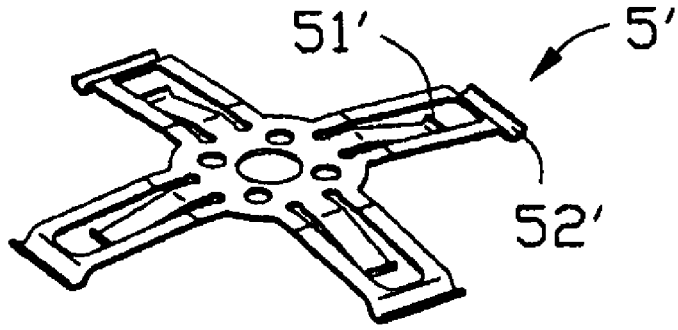
FIG. 6 is a perspective view of a first movable contact used in a multi-direction switch according to a second embodiment of the present invention.
Figure 7:
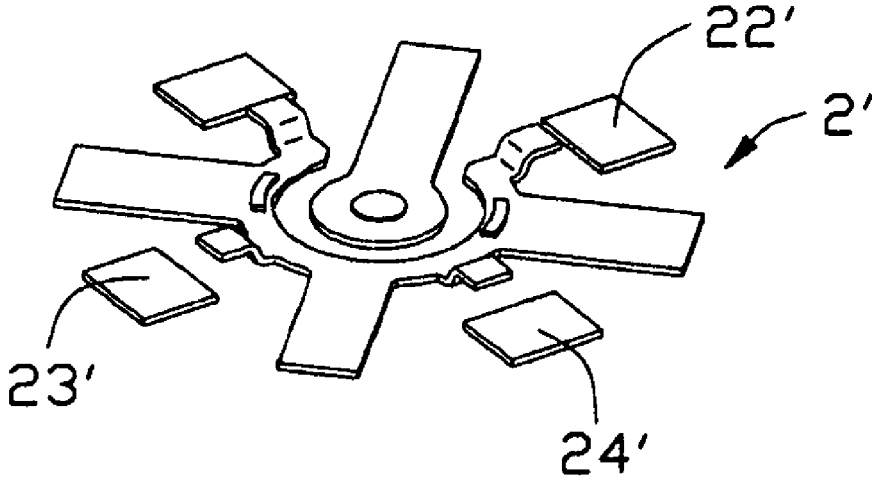
FIG. 7 is a perspective view of fixed contacts used in the multi-direction switch according to a second embodiment of the present invention.

Referring to FIGS. 2, 6 and 7, a multi-direction switch 10 according to a second embodiment of the present invention comprises a first movable contact 5' and fixed contacts 2'. The first movable contact 5' includes a plurality of movable contact portions 52'. Each movable contact portion 52' is stamped out a corresponding constant contact portion 51' with a free end substantially extending radially and outwardly. The fixed contact 2' includes common fixed contacts 22' and first fixed contacts 23', 24'. The constant contact portions 51' touch the common fixed contacts 22'. One of the movable contact portions 52' touches one of the first fixed contacts 23', 24' when the driving device 6 is titled. In this embodiment, the switch has a construction similar to the first embodiment, thus, a detailed description thereof is omitted herefrom.

Figure 8:
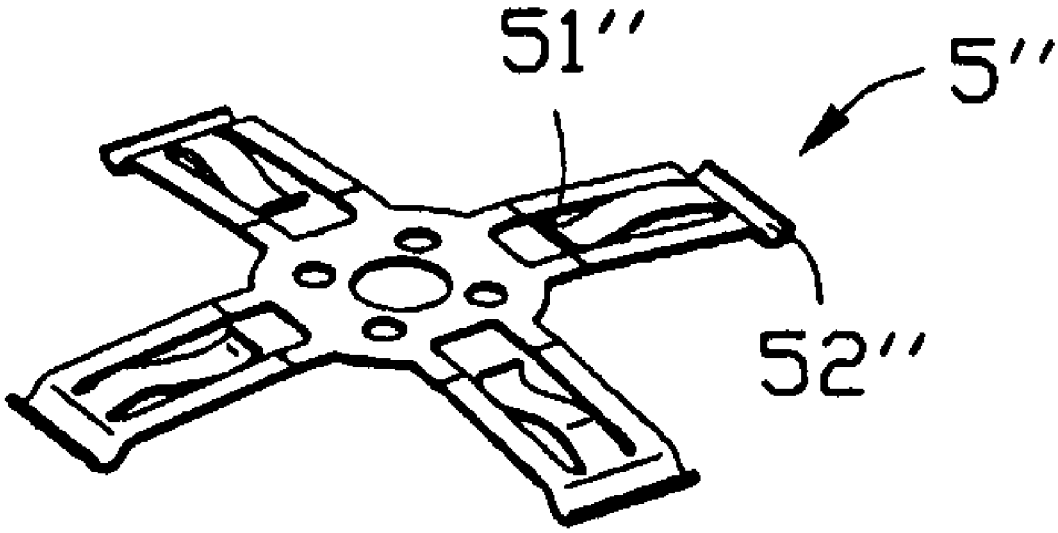
FIG. 8 is a perspective view of a first movable contact used in a multi-direction switch according to a third embodiment of the present invention.

Referring to FIGS. 2, 7 and 8, a multi-direction switch 10 according to a third embodiment of the present invention comprises a first movable contact 5" and fixed contacts 2'. The first movable contact 5" includes constant contact portions 51" and movable contact portions 52". The constant contact portions 51" are stamped out the movable contact portions 52". The constant contact portions 51" extend from free ends of the movable contact portions 52" to a center of the first movable contact 5". The constant contact portions 51" contact the common fixed contacts 22'. One of the movable contact portions 52" touches one of the first fixed contacts 23', 24' when the driving device 6 is tilted. In this embodiment, the switch has a construction similar to the first embodiment, thus, a detailed description thereof is omitted herefrom.

It is to be understood, however, that even though numerous, characteristics and advantages of the present invention have been set forth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. A multi-direction switch comprising:

a housing having a bottom and a plurality of anchor grooves;

a cover mounting on said housing;

common fixed contacts disposed on said bottom of said housing;

first fixed contacts disposed on said bottom of said housing;

a first movable contact having constant contact portions and movable contact portions corresponding to said first fixed contacts, said constant contact portions touching said common fixed contacts; and a driving device extending through said cover and having first depressing portions and anchor arms, said first depressing portions selectively depressing one of said movable contact portions to touch a corresponding first fixed contact, said anchor arms received in said anchor grooves and abutting against said anchor grooves, thereby ensuring stable and reliable operation of said driving device.

2. The multi-direction switch of claim 1, wherein said constant contact portions and said movable contact portions are alternately formed.

3. The multi-direction switch of claim 1, wherein said constant contact portions are longer than said movable contact portions and extend in radial direction.

4. The multi-direction switch of claim 1, wherein each said movable contact portions is stamped out each said constant contact portions with a free end substantially extending radially and outwardly.

5. The multi-direction switch of claim 1, wherein said driving device comprises a second depressing portion and holding posts.

6. The multi-direction switch of claim 5, wherein said first movable contact comprises a central through hole and peripheral through holes.

7. The multi-direction switch of claim 6, wherein said second depressing portion is received in said central through hole.

8. The multi-direction switch of claim 6, wherein said holding posts are held in said peripheral though holes.

9. The multi-direction switch of claim 5, further comprising a second fixed contact disposed in said common fixed contacts.

10. The multi-direction switch of claim 9, further comprising a second movable contact disposed above said second fixed contact and comprising a central portion and a peripheral portion, said peripheral portion touching said common fixed contacts.

11. The multi-direction switch of claim 10, wherein said second depressing portion depresses said central portion of said second movable contact to touch said second fixed contact.

12. The multi-direction switch of claim 1, wherein said anchor arms outwardly project from an edge of said driving device.

13. The multi-direction switch of claim 12, wherein said anchor arms are thinner than said edge of said driving device.

14. The multi-direction switch of claim 1, wherein said housing comprises a plurality of activity grooves.

15. The multi-direction switch of claim 14, wherein said movable contact portions are received in said activity grooves.

16. A multi-direction switch comprising:

a housing;

at least one common fixed contact disposed on a bottom face of said housing;

a plurality of first fixed contacts disposed on said bottom face of said housing;

a first movable contact having at least one cantilever type constant contact portion touching said common fixed contact, and a plurality of cantilever type movable contact portions vertically aligned with said first fixed contacts; and a driving device movable relative to the housing in both vertical and tilting ways, said driving device located upon the first movable contact having a plurality of first depressing portions selectively depressing one of said movable contact portions to exclusively touch the corresponding first fixed contact.

17. The multi-direction switch as claimed in claim 16, wherein the housing defines a plurality of grooves respectively vertically aligned with the corresponding first fixed contacts, and the driving device further defines a plurality of anchor arms respectively radially aligned with the corresponding depressing portions and respectively received in the corresponding grooves during operation.

18. The multi-direction switch as claimed in claim 17, wherein the movable contact portions are respectively received in the corresponding grooves during said operation.

19. A multi-direction switch comprising:

a housing;

at least one common fixed contact disposed on a bottom face of said housing;

a plurality of first fixed contacts disposed on said bottom face of said housing;

a first movable contact having at least one constant contact portion touching said common fixed contact, and a plurality of movable contact portions vertically aligned with said first fixed contacts; and a driving device movable relative to the housing in both vertical and tilting ways, said driving device located upon the first movable contact having a plurality of first depressing portions selectively depressing one of said movable contact portions to exclusively touch the corresponding first fixed contact; wherein the housing defines a plurality of grooves respectively vertically aligned with the corresponding first fixed contacts, and the driving device further defines a plurality of anchor arms respectively radially aligned with the corresponding depressing portions and respectively received in the corresponding grooves during operation.

20. The multi-direction switch as claimed in claim 19, wherein the movable contact portions are respectively received in the corresponding grooves during said operation.

* * * * *